United States Patent [19]

Iwaki et al.

[11] Patent Number: 4,522,891

[45] Date of Patent: Jun. 11, 1985

[54] SUPPORT FOR LITHOGRAPHIC PRINTING PLATE

[75] Inventors: Akio Iwaki; Norihito Suzuki; Takeshi Yamamoto; Toru Aoki, all of Hino, Japan

[73] Assignee: Konishiroku Photo Industry Co., Ltd., Tokyo, Japan

[21] Appl. No.: 501,156

[22] Filed: Jun. 6, 1983

[30] Foreign Application Priority Data

Jun. 18, 1982 [JP] Japan ..... 57-105726

[51] Int. Cl.[3] ..... B41K 1/50; B41N 1/14

[52] U.S. Cl. ..... 428/626; 428/472; 428/623; 428/624; 428/629; 428/667; 101/401.1

[58] Field of Search ..... 428/472, 623, 629, 632, 428/624, 626, 667; 101/401.1

[56] References Cited

U.S. PATENT DOCUMENTS

| | | | |
|---|---|---|---|
| 3,097,096 | 7/1963 | Oster | 101/401.1 |
| 3,478,684 | 11/1969 | Schafler et al. | 101/401.1 |

FOREIGN PATENT DOCUMENTS

| | | | |
|---|---|---|---|
| 49-27301 | 3/1974 | Japan | 101/401.1 |
| 55-156089 | 12/1980 | Japan | 101/401.1 |
| 56-24193 | 3/1981 | Japan | 101/401.1 |
| 56-67294 | 6/1981 | Japan | 101/401.1 |
| 802112 | 10/1958 | United Kingdom | 101/401.1 |
| 2081178 | 2/1982 | United Kingdom | 101/401.1 |

*Primary Examiner*—Veronica O'Keefe

*Attorney, Agent, or Firm*—Frishauf, Holtz, Goodman and Woodward

[57] ABSTRACT

A support for lithographic printing plate having provided on an iron material (i) a layer substantially consisting of chromium and/or chromium oxide and (ii) a layer consisting essentially of a water soluble polymeric compound and at least one selected from water soluble salts of calcium, magnesium, zinc, barium, strontium, cobalt, manganese, nickel and silicon, in this order.

17 Claims, No Drawings

SUPPORT FOR LITHOGRAPHIC PRINTING PLATE

This invention relates to a support for lithographic printing plate and a method for preparation thereof, more particularly to a support for lithographic printing plate having a layer substantially consisting of chromium and/or chromium oxide on its surface and a method for preparation thereof.

In lithographic printing in general, because of the restrictive condition to use water, there have been employed printing plates prepared by coating a photosensitive solution obtained by dissolving a photosensitive composition in a solvent on a rustless metal support having concavo-convex surface. Usually, as the support for the lithographic printing plate materials, aluminum has been used. However, it involves the drawbacks that it is expensive and may sometimes suffer from cutting during printing because it is flexed at an acute angle when mounted on a printing machine. Recently, in order to overcome these drawbacks, proposals were made about supports for lithographic printing plate having an electrodeposited chromium or a chromium-chromium oxide layer onto an iron material (Japanese Unexamined Patent Publications Nos. 145193/1980 and 162692/1981).

However, in these techniques, hydrophilicity of the support or adhesion between the support and the photosensitive layer are insufficient, and therefore, when employed as a lithographic printing plate, it has the drawback such that printing ink may be adhered onto the non-image portion (where scumming generates) or a part of the image portion may be peeled off during printing for a long term, thus being poor in printing life. Also, it is proposed to obtain a support for lithographic printing plate by treating the surface of a steel treated with chromic acid with an aqueous silicate solution, an aqueous aluminate solution, an aqueous zirconic fluoride solution or an aqueous or alcoholic solution of a hydrophilic resin to make it hydrophilic (Japanese Patent Publication No. 31277/1981).

However, in the experiments made by the present inventors, these technique also proved to be not free from the above drawbacks.

Accordingly, an object of this invention is to provide a support for lithographic printing plate which does not undergo cutting during printing and a method for preparation thereof. Another object of this invention is to provide a support for lithographic printing plate which is sufficiently hydrophilic, also excellent in adhesion to the photosensitive layer and has a high printing life. Other objects of this invention will be apparent from the disclosures and examples set forth below.

As the result of intensive studies, the present inventors have found that the above objects can be accomplished by a support for lithographic printing plate having, in order, provided on an iron material (i) a layer substantially consisting of chromium and/or chromium oxide and (ii) a layer containing at least one selected from water soluble salts of calcium, magnesium, zinc, barium, strontium, cobalt, manganese, nickel and silicon and a water soluble polymeric compound, and by a method for preparing a support for lithographic printing plate, which comprises treating the surface of a layer substantially consisting of chromium and/or chromium oxide provided on an iron material with a solution containing at least one selected from water soluble salts of calcium, magnesium, zinc, barium, strontium, cobalt, manganese, nickel and silicon and a water soluble polymeric compound.

The present invention will be described in detail below.

The iron material to be used in this invention is inclusive of pure iron and also alloys of iron with other elements. As other elements forming alloys with iron, there may be included carbon, manganese, nickel, and others.

Typical examples of alloys may include carbon steels (alloys of carbon (0.04 to 1.7%) and iron), cast irons with higher contents of carbon than carbon steels, and further special steels (e.g. manganese steel, nickel steel, chromium steel, nickel-chromium steel) having added other elements (e.g. manganese, nickel, chromium, cobalt, tungsten, molybdenum), etc.

The above carbon steels may include super-soft steels (0.25% or less carbon), soft steels (0.25 to 0.5% carbon), hard steels (0.5 to 1.0% carbon) and super-hard steels (1.0% or more carbon).

The iron material of this invention may also include those having zinc, nickel, copper, tin, etc. laminated on these iron materials by the method such as plating, etc.

The layer substantially consisting of chromium and/or chromium oxide provided on the iron material may include a layer consisting of chromium, a layer consisting of chromium oxide, a layer in which chromium oxide is provided on chromium, a layer in which chromium is provided on chromium oxide, a layer in which chromium and chromium oxide exist as a mixture, and others. The term "substantially consisting of" in the layer substantially consisting of chromium and/or chromium oxide as mentioned above means that the sum of the respective percentages of the numbers (atomic concentration) of chromium atoms and oxygen atoms comprise 50% or more in the elemental composition consisting said layer. Said layer may also contain other components than chromium atoms and oxygen atoms such atoms as carbon, chlorine, sulfur, calcium, nitrogen, fluorine, etc. within the range which does not impair the effect of this invention. The chromium oxide may be inclusive of divalent, trivalent or hexavalent chromium oxides and hydrates thereof. The above layer substantially consisting of chromium and/or chromium oxide may have a thickness preferably of 0.001 to 10$\mu$, particularly preferably 0.005 to 4$\mu$.

As the method for providing the layer substantially consisting of chromium and/or chromium oxide on an iron material, there may be employed those conventionally practiced in the art. For example, there may be employed the so called chromium electroplating method in which electrolysis is carried out in an aqueous solution containing anhydrous chromic acid as the main component using an iron material as the cathode; the so called chromic acid heat treatment method in which an iron material is dipped in an aqueous bichromate solution or an aqueous solution containing chromic acid and reducing agent is thinly coated on the surface of an iron material, followed by baking at about 120° C. thereby to form a thin layer of chromium oxide; the electrolytic chromic acid treatment method in which electrolysis is carried out in an aqueous anhydrous chromic acid solution to which additives such as disulfonic acid, thiocyanates, etc. are added, using an iron material as the cathode to provide a chromium oxide layer or a layer having a chromium oxide on chromium; and further the vacuum vapor deposition method. These methods may also be used in combinations, if desired.

One of the preferable iron material having a layer substantially consisting of chromium and/or chromium oxide is an iron material having an electrodeposited chromium layer, having an elemental composition substantially consisting of chromium and oxygen in the surface side portion of said electrodeposited layer and ratio of atomic concentrations of chromium atom and oxygen atom being substantially even at the same depth from every point on said surface. This iron material is to be described in detail below.

In this iron material, the constitutional ratio of the respective atoms such as oxygen, chromium and iron constituting the substrate material may be varied within the region of from the surface of the electrodeosited chromium layer toward the substrate (iron material); such that oxygen atoms, without being increased or after slightly being increased, soon begin to be decreased; chromium atoms, after being increased, are gradually decreased as they approach the substrate; and the atoms constituting the substrate such as iron, etc. begin to exist at a certain depth from the surface of the electrodeposited chromium layer, being increased as the depth is deeper.

The above electrodeposited chromium layer is constituted in the substrate side substantially of the atoms constituting the substrate and chromium atoms, and the constitutional ratios are varied continuously such that the ratio of the atoms constituting the substrate becomes greater and the ratio of chromium smaller as nearer to said substrate. The above electrodeposited chromium layer refers to a region of from the support surface to a position at which the number of the atoms constituting the substrate and the number of chromium atoms are identical, and its thickness may be preferably 0.01 to 10 $\mu$m, particularly preferably 0.01 to 4 $\mu$m. The thickness can be determined by fluorescent X-ray analysis as an average value by the quantitative determination with reference to the calibration curve previously prepared from the standard chromium plated layers with known thicknesses. The above wording "the electrodeposited chromium layer is constituted, in the substrate side, substantially of the atoms constituting the substrate and chromium atoms" means that the sum of the respective atomic concentrations of the atoms constituting the substrate and chromium atoms is 60% or more.

The above wording "the surface side portion of the electrodeposited chromium layer" refers to the portion of from the surface of said electrodeposited layer to the position where the atomic concentration of the atoms constituting the substrate exceeds 20%, and "the elemental composition in the surface side portion consists substantially of chromium and oxygen" means that the sum of the respective atomic concentrations of chromium atoms and oxygen atoms is 50% or more, thus meaning that other components than chromium atoms and oxygen atoms, for example, carbon atoms, chlorine atoms, sulfur atoms, calcium, nitrogen atoms, fluorine atoms, etc., may be permitted to be contained within the range which does not impair the effect of this invention.

The above atomic concentrations can be determined by the surface analytical means such as photoelectric spectroscopy (e.g. X-ray photoelectric spectroscopy), and Auger electron spectroscopy. The profile of the elements in the direction of depth of the electrodeposited chromium layer as mentioned above may be determined by Auger electron spectroscopy, and the atomic concentrations at various depths at various portions of the electrodeposited chromium layer can be determined by local analyses by means of the Scanning Auger Microprobe (e.g., PHI. Model 595 or 600) produced by Perkin Elmer Co.

The elemental composition in the surface side portion of the electrodeposited chromium layer may preferably be such that, in variations of the atomic concentrations of chromium and oxygen in the depth direction along the normal line on the electrodeposited chromium layer surface, the atomic concentration ya % of chromium at the depth of Xnm from said surface is within the range satisfying the conditions as represented by the formula (I) $ya \leqq -0.464X^2+7.82X+70$ (where $0 \leqq X \leqq 6$) and the formula (II) $ya \geqq -0.0398X^2+1.99X+15$ (where $0 \leqq X \leqq 25$), and the atomic concentration yb % of oxygen within the range satisfying the conditions as represented by the formula (III) $yb \leqq 0.0884X^2-4.46X+80$ (where $0 \leqq X \leqq 25$) and the formula (IV) $yb \geqq 0.5X^2-8.1X+20$ (where $0 \leqq X \leqq 3$), and further the sum of ya and yb may preferably be within the range satisfying the formula (V) $ya+yb \geqq -0.0187X^2+1.23X+50$ (where $0 \leqq X \leqq 25$). And, it is further preferred that at $Xnm < 1.0$ nm, $yb > ya$, and the depth Xonm when $ya = yb$ is within the range $1.0 \leqq Xo \leqq 14.0$, particularly preferably $1.5 \leqq Xo \leqq 8$.

The above depths from the surface were determined by transformation based on the depth direction analyses as described below.

As the measuring conditions for the depth direction analyses by means of the aforesaid PHI Model 595, argon ion was used as the ion gun and etching was effected at a speed of 20 Å/min. with thallium oxide ($Ti_2O_5$) as the standard (determined from the time for etching of $Ti_2O_5$ with known film thicknesses), and further in calculation of the elemental composition, the peak intensities of the Auger spectrum (differential form) employed concern the peak at 529 eV for chromium and the peak at 503 eV for oxygen, the relative sensitivities of chromium and oxygen employed being the values as disclosed in L. E. Davis, P. W. Palberg, G. E. Riach, R. E. Weber, N. C. MacDonald "Handbook of Auger Electron Spectroscopy sec. ed." (Physical Electronics Division Perkin-Elmer Corp., 1976).

The depth Xnm from the surface as defined above is obtained by transforming the etching time from the aforesaid etching speed into depth, being calculated on the basis that all the compositions are chromium oxide ($Cr_2O_3$).

Further, the aforesaid elemental composition shows the ratio of atom number per unit area.

The elemental composition in the surface side portion of the electrodeposited chromium layer substantially consists of chromium and oxygen and the respective elemental compositions of chromium and oxygen at said portion are substantially even at the same depth from said surface and at respective portions on said surface. The wording "substantially even" means that, in the element profile in the depth direction at each portion, the value of Xo is within the range of error of $\pm 80\%$. The above error is calculated by dividing the difference between the two values by the greater value of the both values and multiplying the resultant value by 100.

The surface shape of the layer substantially consisting of chromium and/or chromic acid in this invention may be flat but preferably have concavo-convex surfaces. As typical examples having concavo-convex surfaces, there may be mentioned one having an electrodeposited chromium layer constituted of coalescively agglomerated assemblages of subagglomerated shperoidate particles of generally lobular curvilinear contour characterized by an effective absence of generally planar exterior surfaces and relativbely sharp protuberant angles, as disclosed in European Patent Publication No. 20021; and also an electrodeposited chromium layer, wherein the surface of said electrodeposited layer has a shape having protuberant crystalline products with angles protruded thereon, the elemental composition in the surface side portion of said electrodeposited layer consists substantially of chromium and oxygen and the respective elemental compositions of chromium and oxygen in said portion are substantially even at the same depth from said surface and at every portion on said surface, as disclosed in Japanese Patent Application No. 105724/1982, filed on even date with the present application by the present Applicant (Title of the invention: "SUPPORT FOR LITHOGRAPHIC PRINTING PLATE"), the latter being particularly preferred.

As the above shape of protuberant crystalline products with angles of the electrodeposited layer preferably has the shape of plate or hexahedral (e.g. cubic) crystals, or an agglomerated product of these crystals or a mixture of said crystals and/or said agglomerated product. As the plate crystals are preferred polygonal (primarily hexagonal) plates, and the polygonal shape may have sizes of planes preferably of 0.5 to 5 μm and thicknesses preferably of 0.01 to 0.8 μm. As the hexahedral crystals, cubic crystals, especially those having side lengths of 0.1 to 2 μm are preferred.

The methods for preparation of the iron materials having electrodeposited chromium layers having a surface containing concavo-convex surfaces as mentioned above are described in detail in the above-mentioned European Patent Publication No. 20021 and Japanese Patent Application No. 105724/1982, filed on even date with the present application by the present Applicant (Title of the invention: "SUPPORT FOR LITHOGRAPHIC PRINTING PLATE").

Typical examples of the preparation method for obtaining an iron material having an electrodeposited chromium layer having a shape with angular crystalline products exposed on the surface are shown below.

After the surface of an iron material such as an iron plate is subjected optionally to a gas honing treatment, as the pre-treatment step, the Electrolyte as shown in Table 1 and an iron plate as the counter-cathode were used, and electrolytic treatment is carried out under the Electrolysis Conditions 1 as shown in Table 2.

TABLE 1

| Electrolyte 1 | |
|---|---|
| Anhydrous chromic acid | 80–200 g |
| Nitric acid (64%) | 0.5–1 ml |
| make up to one liter with water | |

TABLE 2

| Electrolysis Conditions 1 | |
|---|---|
| Direct current voltage | 4–10 V |
| Current density | 2–10 A/dm$^2$ |
| Liquid temperature | 10° C.–40° C. |
| Anode | Iron material |
| Area ratio of cathode to anode | 1:1 |
| Treatment time | 30 sec.–5 min. |

The thus pre-treated iron was washed with water by spraying a shower thereon and then transferred to the main treatment step.

This main treatment step is a step for forming the electrodeposited chromium layer in which Electrolyte 2 as shown in Table 3 is cooled or heated by a coil tube for temperature control to adjust the liquid temperature, and electrolytic treatment is conducted under the Electrolysis Conditions 2 as shown in Table 4. The Electrolyte 2 is an electrodeposited chromium layer forming solution for formation of an electrodeposited chromium layer on the surface of the iron material.

TABLE 3

| Electrolyte 2 | |
|---|---|
| Anhydrous chromic acid ($Cr_2O_3$) | e.g., 400 g and 430 g 100–500 g |
| Barium compound | 1–10 g |
| Fluoride, e.g. hydrogen fluoride (HF) | 0–20 g |
| Nitric acid | 0–10 g |
| Acetic acid | 0–1 g |
| make up to one liter with water | |

TABLE 4

| Electrolysis Conditions 2 | |
|---|---|
| Direct current voltage | 5–15 V |
| Current density | 5–50 A/dm$^2$ |
| Liquid temperature | 30–60° C. |
| Cathode | Iron material |
| Anode | Lead electrode |
| Area ratio of cathode to anode | 1:1 to 1:1.5 |
| Treatment time | 2–6 min. |

The water soluble polymeric compounds to be used in the present invention in the layer to be provided on the layer substantially consisting of chromium and/or chromium oxide may preferably have solubilities of 0.01% or higher. As preferable water soluble polymeric compounds, there may be included natural polymeric compounds such as gum arabic, starch, dextrin, sodium alginate, gelatin, etc.; water soluble cellulose compounds such as water soluble salts of carboxyalkyl cellulose (as alkyl; methyl, ethyl, propyl, etc.), alkyl celluloses (as alkyl; methyl, hydroxymethyl, hydroxyethyl, hydroxypropyl and the like); synthetic polymeric compounds such as polyacrylic acid or water soluble salts thereof, polymethacrylic acid or water soluble salts thereof, acrylic acid copolymers or water soluble salts thereof, methacrylic acid copolymers or water soluble salts thereof, styrene-maleic anhydride copolymer, polyvinyl alcohol, polyacrylamide, polyvinyl pyrrolidone, etc. The water soluble salts of these polymeric compounds may include sodium and potassium salts. The above various water soluble polymeric compounds may be used either singly or in combination of two or more kinds. Among the water soluble polymeric compounds, natural polymeric compounds such as starch, dextrin, etc. and water soluble cellulose compounds are preferred. These polymeric compounds may have molecular weights preferably of 500 to 1,000,000.

Water soluble salts to be used together with the water soluble polymeric compound are preferably those having solubilities of 0.01% or higher, particularly salts of inorganic or organic acids with calcium, magnesium, zinc, barium, strontium, cobalt, manganese, nickel or silicon. The salts may contain complex salts. Typical organic acid salts are those of low molecular carboxylic acids such as acetic acid, propionic acid, butyric acid, succinic acid, benzoic acid and salicylic acid and acetylacetone complex. Typical inorganic salts are chlorides, bromides, chlorate, bromate, iodides, iodate, nitrates, sulfates and phosphates. Water soluble salts may be used either singly or in combination of two or more kinds.

As the water soluble salt, an organic salt is particularly preferred, and the salts with calcium, magnesium, barium and zinc are particularly preferred.

The amount of the layer containing the water soluble polymeric compound and the water soluble salt after drying is preferably 0.001 to 1 mg/dm$^2$, particularly 0.05 to 0.5 mg/dm$^2$.

As the method for providing a layer containing a water soluble polymeric compound and a water soluble salt, there may preferably be employed the method in which, after washing the surface of the layer substantially consisting of chromium and/or chromium oxide provided on the iron material with an aqueous acidic or alkaline solution, if desired, the surface is applied thereon with a surface treating solution containing a water soluble polymeric compound and at least one selected from the water soluble salts of calcium, magnesium, zinc, barium strontium, cobalt, manganese, nickel and silicon.

As the solvent for dissolving the above water soluble polymeric compounds and water soluble salts, there may preferably employed water, methanol, ethanol, methyl cellosolve, or mixtures of water and an organic solvent miscible with water such as methanol, ethanol, acetone, methyl cellosolve, ethyl cellosolve, dioxane, etc. The above surface treating solutions may preferably contain the water soluble polymeric compound and the water soluble salt each at a concentration of 0.05 to 3% by weight (the total solid content being preferably 0.1 to 6% by weight). In the above surface treating solution, there may also be added a humectant such as surfactants, etc., if desired.

As the method for surface treatment, there may be employed the method in which a surface treating solution is coated on the layer substantially consisting of chromium and/or chromium oxide, the method in which the surface treating solution is sprayed on said layer or the method in which the iron material having said layer is dipped in the surface treating solution.

On the surface-treated support for lithographic printing plate thus obtained, there are provided various photosensitive compositions to give an original plate for lithographic printing. In the following, description is made about the photosensitive compositions to be applied.

(1) Photosensitive resin compositions:

Included are compositions comprising photosensitive resins having unsaturated double bonds in molecules, including, for example, photosensitive resins containing photosensitive groups:

$$-CH{=}CH-\overset{\overset{\displaystyle O}{\|}}{C}-$$

in the main chains of polymers, as disclosed in U.S. Pat. Nos. 3,030,208; 3,453,237 and 3,622,320, and polyvinyl cinnamates having photosensitive groups in the side chains of polymers.

(2) Photopolymerizable photosensitive compositions:

These compositions comprise monomers having double bonds and binders (polymeric compounds), typically the compositions as disclosed in U.S. Pat. Nos. 2,760,863; 2,791,504 and 3,801,328.

(3) Photosensitive compositions containing diazo compounds:

Included are compositions comprising diazo resins and binders (film forming resins), as exemplified by the photosensitive compositions disclosed in Japanese Patent Publication No. 1167/1972, Japanese Unexamined Patent Publications Nos. 18585/1975, 118802/1975, 98613/1979 and 98614/1979.

(4) Photosensitive compositions containing azide compounds:

For example, there may be included photosensitive compositions comprising azide compounds and water soluble or alkali soluble polymeric compounds as disclosed in U.S. Pat. Nos. 2,852,397 and 2,940,853; U.K. Pat. Nos. 886,100 and 892,811; Japanese Patent Publications Nos. 34930/1977 and 34933/1977 or photosensitive compositions comprising polymers having azide groups as disclosed in Japanese Unexamined Patent Publication Nos. 5102/1975, 84302/1975, 12984/1978 and 135525/1979.

(5) Photosensitive compositions containing o-quinonediazide compounds:

For example, there may be included compositions comprising o-naphthoquinonediazide compounds and alkali soluble resins as disclosed in U.S. Pat. Nos. 3,184,310 and 3,535,157; Japanese Unexamined Patent Publications Nos. 48403/1974, 57841/1980 and 1044/1981; Japanese Patent Publications Nos. 7842/1975 and 14042/1976.

The thus obtained original plate for printing is then subjected to imagewise exposure, followed by developing with a developer suitable for the photosensitive composition, to give a printing plate. When printing was performed after mounting the printing plate obtained on a printing machine, no cutting of the plate occurred in the course of a very long printing step and there were obtained many printed products having clear images.

This invention is described in further detail by referring to the following Examples, by which the embodiments of this invention are not limited.

EXAMPLE 1

On an iron plate was applied a gas honing treatment (this step can be obviated when no foreign matter exists on the surface of the iron plate). Then, as the pre-treatment step, electrolytic treatment was applied, using the Electrolyte III as shown in Table 5 and an iron plate as the counter-electrode, under the Electrolysis Conditions III as shown in Table 6.

TABLE 5

| Electrolyte III | |
|---|---|
| Anhydrous chromic acid | 100 kg |
| Nitric acid (64%) | 0.8 lit. |
| Water | 1000 lit. |

TABLE 6

| Electrolysis Conditions III | | |
|---|---|---|
| Direct current | | 6 V |
| Current density | | 4 A/dm$^2$ |
| Liquid temperature | | 25° C. |
| Cathode | Iron plate | (1.2 m$^2$) |
| Anode | Iron plate for plate material | (1.2 m$^2$) |
| Treatment time | | 1 min. |

The thus pre-treated iron plate was washed with by spraying with water and then applied with the main treatment step. The Electrolyte IV and the Electrolysis Conditions IV in the main treatment step are shown in Table 7 and Table 8, respectively.

TABLE 7

| Electrolyte IV | |
|---|---|
| Anhydrous chromic acid | 400 kg |
| Sulfuric acid | 2.5 kg |
| Pure water | 1000 lit. |

TABLE 8

| Electrolysis Conditions IV | | |
|---|---|---|
| Direct current | | 4 V |
| Current density | | 20 A/dm$^2$ |
| Liquid temperature | | 50° C. |
| Cathode | Iron plate for plate material | (1.2 m$^2$) |
| Anode | Lead plate | (1.6 m$^2$) |
| Treatment time | | 20 sec. |

The iron plate having been thus finished with the main treatment step was then washed by showering with water, and thereafter immersed in an aqueous 5 wt. % caustic soda solution at 40° C. for one minute, followed by washing with water, and subsequently subjected to the surface treatment by being immersed in a surface treating solution as shown in Table 9 at 50° C. for 60 seconds. After the surface treatment, the iron plate was washed with water and dried to obtain a support. The amount of the layer after dried was 0.12 mg/dm$^2$.

TABLE 9

| Surface treating solution | |
|---|---|
| Carboxymethyl cellulose sodium salt (produced by Wako Junyaku Kogyo Co., Ltd.) | 200 g |
| Calcium acetate | 200 g |
| Pure water | 100 lit. |

Subsequently, the support was coated with a photosensitive coating solution having the following composition by a whirler, followed by drying at 100° C. for 4 minutes, to obtain an original plate for lithographic printing.

| [Photosensitive coating solution composition] | |
|---|---|
| Esterified product of naphthoquinone-(1,2)-diazide-(2)-5-sulfonic acid chloride and m-cresol-formaldehyde novolac resin (condensation degree: 25 mol %) | 3.5 g |
| m-Cresol-formaldehyde novolac resin | 8.0 g |
| Napthoquinone-(1,2)-diazide-(2)-4-sulfonic acid chloride | 0.15 g |
| Esterified product of p-octylphenol novolac resin and naphthoquinone-(1,2)-diazide-(2)-5-sulfonic acid chloride (condensation degree: 50 mol %) | 0.12 g |
| Oil blue #603 (produced by Orient Kagaku Kogyo Co., Ltd.) | 0.2 g |
| Ethyl cellosolve | 100 g |

The weight of the coating after drying was about 2.7 g/m$^2$.

On the thus obtained original plate for lithographic printing were closely contacted a posi-manuscript film, and light exposure was applied by a 2 KW metal halide lamp (Idolfin 2000 produced by Iwasaki Denki Co., Ltd.) as the light source from a distance of 1 m for 80 seconds, followed by development with an aqueous 4% sodium metasilicate solution at 25° C. for 45 seconds to obtain a lithographic printing plate.

Next, this printing plate was mounted on an offset printing machine and printing was carried out to obtain a large number of printed products with clear images.

EXAMPLE 2

A steel plate was treated by the method disclosed in European Patent Publication No. 20021 to provide an elecrodeposited chromium layer thereon, then immersed in an aqueous 5 wt. % caustic soda solution at 40° C. for one minute and after washing with water subjected to the same surface treatment as in Example 1, followed by washing with water and drying. The amount of the layer was 0.13 mg/dm$^2$.

Next, on this support was coated a photosensitive coating solution having the composition shown below by use of a whirler, followed by drying at 85° C. for 3 minutes, to obtain an original plate for lithographic printing.

| [Photosensitive coating solution composition] | |
|---|---|
| Copolymer A | 5.0 g |
| Diazo resin | 0.5 g |
| Jurymer-AC-10L (produced by Nippon Junyaku Co.) | 0.05 g |
| Aizen Victoria Pure Blue BOH (produced by Hodogaya Kagaku Co.) | 0.1 g |
| Methylcellosolve | 100 ml |

(The above copolymer A was obtained by dissolving a composition in terms of molar ratio of p-hydroxyphenyl methacrylamide/acrylonitrile/ethyl acrylate/methacrylic acid=10/30/60/6 and 1/400 mole of azobisisobutyronitrile to the above monomers in methyl cellosolve, heating the solution in a sealed tube replaced with nitrogen at 65° C. for 10 hours, and after completion of the reaction pouring the reaction mixture into water under stirring, followed by filtration and drying of the white precipitates formed. The diazo resin B is a hexafluorophosphoric acid salt obtained by mixing an aqueous 5% diazo resin (trade name: D-012 produced by E.H.C. Co.) and an aqueous 10% ammonium hexafluorophosphate, recovering the precipitates formed by suction filtration and drying the precipitates under reduced pressure at 30° to 40° C. The above copolymer had a weight average molecular weight of 80,000, and further the molecular weight distribution of the above diazo resin was measured by gel permeation chromatography (GPC) to find that the fractions with molecular weights of trimer or lower comprise 93% of the total fractions.). The weight of the coating after drying was 2.0 g/m$^2$.

On the thus obtained original plate for lithographic material was closely contacted a negative manuscript film and light exposure was applied thereon at a distance of 1 m from a 2 KW metal halide lamp (Idolphin 2000, produced by Iwasaki Denki Co., Ltd.) as the light source, followed by development with a developer having the following composition, to obtain a lithographic printing plate.

| [Composition of developer] | |
|---|---|
| Phenyl cellosolve | 160 g |
| Diethanolamine | 70 g |
| Pionin A-44B (produced by Takemono Yushi Co., Ltd.) | 50 g |
| Water | 780 g |

Next, this printing plate was mounted on an offset printing machine and printing was carried out to obtain a large number of printed products with clear images.

EXAMPLE 3

A printing plate was obtained according to entirely the same procedure as in Example 1 except that the Electrolyte V (shown in Table 10) was employed in place of the Electrolyte IV in the main treatment step. The printing performance was good similarly as in Example 1.

TABLE 10

| Electrolyte V | |
|---|---|
| Anhydrous chromic acid | 430 kg |
| Barium nitrate | 3.8 kg |
| Nitric acid (64%) | 1.2 lit. |
| Ammonium hydrofluoride | 5 kg |
| Acetic acid | 0.2 kg |
| Barium fluoride | 0.1 kg |
| Water | 1000 lit. |

EXAMPLE 4

A printing plate was obtained according to entirely the same procedure as in Example 1 except that the surface treating solution as shown in Table 11 was employed as the surface treating solution in the surface treatment step. The printing performance was good similarly as in Example 1.

TABLE 11

| Surface treating solution | |
|---|---|
| Carboxymethyl cellulose sodium salt (produced by Wako Junyaku Kogyo Co., Ltd.) | 400 g |
| Zinc acetate | 400 g |
| Pure water | 100 lit. |

EXAMPLE 5

A printing plate was obtained according to entirely the same procedure as in Example 1 except that the surface treating solution as shown in Table 12 was employed as the surface treating solution in the surface treatment step. The printing performance was good similarly as in Example 1.

TABLE 12

| Surface treating solution | |
|---|---|
| Gum arabic | 300 g |
| Magnesium acetate | 300 g |
| Pure water | 100 lit. |

EXAMPLE 6

A printing plate was obtained according to entirely the same procedure as in Example 1 except that the surface treating solution as shown in Table 13 was employed as the surface treating solution in the surface treatment step. The printing performance was good similarly as in Example 1.

TABLE 13

| Surface treating solution | |
|---|---|
| Polyacrylic acid (trade name: Jurymer-AC-10 P, produced by Nippon Junyaku Co., Ltd.) | 1.0 kg |
| Cobalt acetate | 1.0 kg |
| Pure water | 1000 lit. |

In the following, for clarifying the effect of this invention, Comparative tests were conducted. The comparative test results of Examples and Comparative Examples are summarized in Table 14.

COMPARATIVE EXAMPLE 1

Example 1 was repeated except that the surface treatment step was omitted to obtain a lithographic printing plate.

COMPARATIVE EXAMPLE 2

A lithographic printing plate was obtained according to entirely the same procedure as in Example 2 except that the surface treating solution as shown below was employed as the surface treating solution in the surface treatment step.

| | |
|---|---|
| Potassium fluorozirconate | 1.0 Kg |
| Pure water | 100 lit. |

COMPARATIVE EXAMPLE 3

A lithographic printing plate was obtained according to entirely the same procedure as in Example 3 except that the surface treating solution as shown below was employed as the surface treating solution in the surface treatment step.

| | |
|---|---|
| Sodium metasilicate | 4.0 Kg |
| Pure water | 100 lit. |

COMPARATIVE EXAMPLE 4

A lithographic printing plate was obtained according to entirely the same procedure as in Example 1 except that the surface treating solution as shown below was employed as the surface treating solution in the surface treatment step.

| | |
|---|---|
| Gum arabic | 400 g |
| Pure water | 100 lit. |

COMPARATIVE EXAMPLE 5

A lithographic printing plate was obtained according to entirely the same procedure as in Example 1 except that the surface treating solution as shown below was employed as the surface treating solution in the surface treatment step.

| | |
|---|---|
| Carboxymethyl cellulose sodium salt (produced by Wako Junyaku Kogyo Co., Ltd.) | 300 g |
| Pure water | 100 lit. |

TABLE 14

| | Comparisons of printing tests | |
|---|---|---|
| | Results of printing tests | Printing life |
| Example 1 | No scumming (high hydrophilicity), no cutting | 150,000 or more |
| Example 2 | No scumming (high hydrophilicity), no cutting | " |
| Example 3 | No scumming (high hydrophilicity), no cutting | " |
| Example 4 | No scumming (high hydrophilicity), no cutting | " |

TABLE 14-continued

| | Comparisons of printing tests | |
|---|---|---|
| | Results of printing tests | Printing life |
| Example 5 | No scumming (high hydrophilicity), no cutting | " |
| Example 6 | No scumming (high hydrophilicity), no cutting | " |
| Comparative Example 1 | Scumming generated at initial stage of printing (insufficient hydrophilicity | — |
| Comparative Example 2 | Photosensitive layer peeled off at initial stage of printing (insufficient adhesion) | — |
| Comparative Example 3 | Photosensitive layer peeled off at initial stage of printing (insufficient adhesion) | — |
| Comparative Example 4 | Scumming generated (insufficient hydrophilicity) | — |
| Comparative Example 5 | Scumming generated (insufficient hydrophilicity) | — |

Printing machine employed: Hamadastar CD x 90 (produced by Hamada Printing Machine Manufacturing Co.)

We claim:

1. A support for a lithographic printing plate having provided on an iron material (i) a layer substantially consisting of at least one material selected from the group consisting of chromium and chromium oxide and (ii) a layer on said layer (i) consisting essentailly of (i') a water soluble polymeric compound and (ii') at least one salt selected from the group consisting of the water soluble salts of calcium, magnesium, zinc, barium, strontium, cobalt, manganese, nickel and silicon.

2. The support for lithographic printing plate according to claim 1, wherein the layer (i) is an electrodeposited chromium layer.

3. The support for lithographic printing plate according to claim 1, wherein the surface of the layer (i) contains concavo-convex surfaces.

4. The support for lithographic printing plate according to claim 1, wherein the water soluble polymeric compound is at least one selected from the group consisting of a natural polymeric compound, a synthetic polymeric compound and a water soluble cellulose compound.

5. The support for lithographic printing plate according to claim 1, wherein the water soluble salt is a salt of an organic acid.

6. The support for lithographic printing plate according to claim 1, wherein the salt is at least one selected from the group consisting of salts with calcium, magnesium, barium and zinc.

7. The support for lithographic printing plate according to claim 1, wherein the layer (ii) is in an amount of from 0.001 to 1 mg/dm$^2$.

8. The support for lithographic printing plate according to claim 1, wherein said water soluble salt and said water soluble polymeric compound have the solubility of 0.01 wt % or higher, respectively, in water.

9. The support for lithographic printing plate according to claim 1, wherein said water soluble polymeric compound is selected from the group consisting of gum arabic, starch, dextrin, sodium alginate and gelatin.

10. The support for lithographic printing plate according to claim 1, wherein said water soluble cellulose compound is one selected from the group consisting of carboxyalkyl cellulose and alkyl cellulose.

11. The support for lithographic printing plate according to claim 1, wherein the water soluble polymeric compound is a natural polymeric compound or a water soluble cellulose compound.

12. The support for lithographic printing plate according to claim 1, wherein said water soluble polymeric compound has molecular weight of 1000 to 500,000.

13. The support for lithographic printing plate according to claim 5, wherein the organic acid has from 2 to 20 carbon atoms.

14. The support for lithographic printing plate according to claim 7, wherein the layer (i) is an electrodeposited chromium layer; and wherein said water-soluble salt is at least one salt selected from the group consisting of the organic acid salts of calcium, magnesium, barium and zinc.

15. The support for lithographic printing plate according to claim 14, wherein the surface of the layer (i) contains concavo-convex surfaces, and wherein said organic acid salts are salts of organic acids containing from 2 to 20 carbon atoms.

16. The support for lithographic printing plate according to claim 15, wherein said water-soluble polymeric compound has a molecular weight of from 1000 to 500,000, and is selected from the group consisting of gum arabic, starch, dextrin, sodium algenate and gelatin.

17. The support for lithographic printing plate according to claim 15, wherein said water-soluble polymeric compound is carboxylalkyl cellulose or alkyl cellulose having a molecular weight of from 1000 to 500,000.

* * * * *